US010894280B2

(12) United States Patent
Huang

(10) Patent No.: US 10,894,280 B2
(45) Date of Patent: Jan. 19, 2021

(54) STRAIGHTENING DEVICE

(71) Applicants: Jih-Cheng Yeh, Taichung (TW); Chun-Hsien Wu, Taichung (TW); Gang Chen, Ningbo (CN)

(72) Inventor: Shang-Yuan Huang, Taichung (TW)

(73) Assignees: Jih-Cheng Yeh, Taichung (TW); Chun-Hsien Wu, Taichung (TW); Gang Chen, Ningbo (TW)

( * ) Notice: Subject to any disclaimer, the term of this patent is extended or adjusted under 35 U.S.C. 154(b) by 171 days.

(21) Appl. No.: 16/148,488

(22) Filed: Oct. 1, 2018

(65) Prior Publication Data

US 2020/0101508 A1 Apr. 2, 2020

(51) Int. Cl.
*B21D 3/05* (2006.01)
*B21D 3/02* (2006.01)

(52) U.S. Cl.
CPC ..... *B21D 3/02* (2013.01); *B21D 3/05* (2013.01)

(58) Field of Classification Search
CPC .... B21D 1/02; B21D 3/02; B21D 3/05; B21F 1/02; B21B 13/10; B21B 13/103
See application file for complete search history.

(56) References Cited

U.S. PATENT DOCUMENTS 128,335 A * 6/1872 Tasker ..... B21D 3/05 72/162
2,740,309 A * 4/1956 Martin, Sr. ..... B21D 3/05 72/458
9,751,121 B2 * 9/2017 Murphy ..... B21D 3/04
9,862,015 B1 * 1/2018 Lin ..... B21D 3/02
2020/0070228 A1 * 3/2020 Tsai ..... B21F 1/02

FOREIGN PATENT DOCUMENTS

GB 2216443 A * 10/1989 ..... B21D 3/05

* cited by examiner

*Primary Examiner* — Edward T Tolan
(74) *Attorney, Agent, or Firm* — Muncy, Geissler, Olds & Lowe, P.C.

(57) ABSTRACT

A straightening device including: a plurality of rolling members, defining a first channel which is configured for a tubular member to pass therethrough, an extending direction of the first channel being transverse to at least one extending direction of at least one pivot of at least one of the rolling members; at least three shells, each of the at least three shells including two arm portions which are transversely connected with each other, the plurality of rolling members being rotatably disposed between the arm portions, at least one side of at least one of the arm portions having a protruding wall, the protruding wall extending along the at least one extending direction of the at least one pivot and being at least partially overlapped with at least one of the plurality of rolling members as viewed in a radial direction of the at least one pivot.

10 Claims, 6 Drawing Sheets

STRAIGHTENING DEVICE

BACKGROUND OF THE INVENTION

Field of the Invention

The present invention relates to a straightening device.

Description of the Prior Art

Metal materials such as metal bars, wires, pipes are commonly used. For example, the pipes are usually used for transportation of refrigerant or fluid. The pipes are usually wound into coils to decrease volume for easy transportation and storage and then cut to appropriate size to use. The metal bars, wires or pipes are deformed by winding so that they should be straightened by a straightening device.

A conventional straightening device includes a machine, input guiding rollers, output guiding rollers, and a stress eliminating roller. The machine has a reinforcing bar inputting side and a reinforcing bar outputting side. The input guiding rollers are disposed close to the reinforcing bar inputting side, and comprise a first input guiding roller and a second input guiding roller. The first input guiding roller and the second input guiding roller are alternatively arranged along a direction from the reinforcing bar inputting side to the reinforcing bar outputting side. The output guiding rollers are disposed close to the reinforcing bar outputting side, and comprise a first output guiding roller and a second output guiding roller. The first output guiding roller and the second output guiding roller are alternatively arranged along a direction from the reinforcing bar inputting side to the reinforcing bar outputting side. The stress eliminating roller is disposed between the input guiding rollers and the output guiding rollers. Therefore, the metal materials are passed from the reinforcing bar inputting side to the reinforcing bar outputting side to achieve straitening effect.

However, the conventional straightening device is huge, heavy and non-portable. In addition, a mechanism of the conventional straightening device is complicated and its assembly is time-consuming.

The present invention is, therefore, arisen to obviate or at least mitigate the above-mentioned disadvantages.

SUMMARY OF THE INVENTION

The main object of the present invention is to provide a straightening device which has a straightening function and is configured for stable holding.

To achieve the above and other objects, the present invention provides a straightening device, including: a plurality of rolling members, defining a first channel which is configured for a tubular member to pass therethrough, the tubular member being abuttable against the plurality of rolling members when passing through the first channel, an extending direction of the first channel being transverse to at least one axial direction of at least one of the rolling members; at least three shells, each of the at least three shells including two arm portions which are transversely connected with each other, each of the arm portions of one of the at least three shells corresponding to one of the arm portions of another of the at least three shells, the plurality of rolling members being rotatably disposed between the arm portions of the at least three shells, at least one side of at least one of the arm portions having a protruding wall, the protruding wall extending along the at least one axial direction of the at least one of the rolling members and being at least partially overlapped with at least one of the plurality of rolling members as viewed in a radial direction of the at least one of the rolling members.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
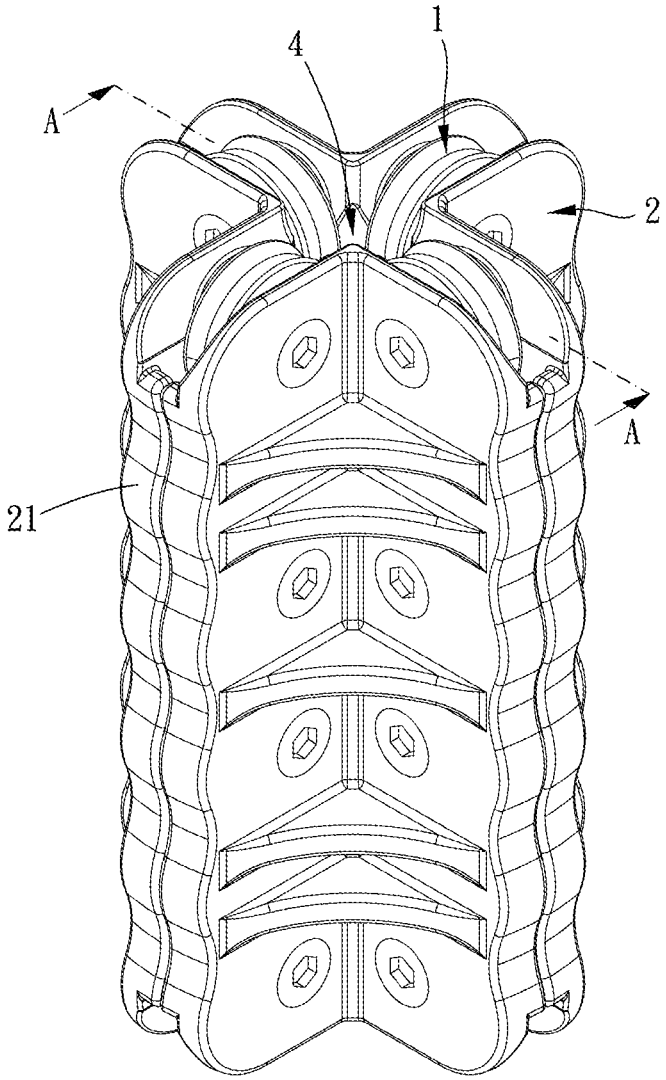
FIG. 1 is a stereogram of a first preferable embodiment of the present invention.
Figure 2:
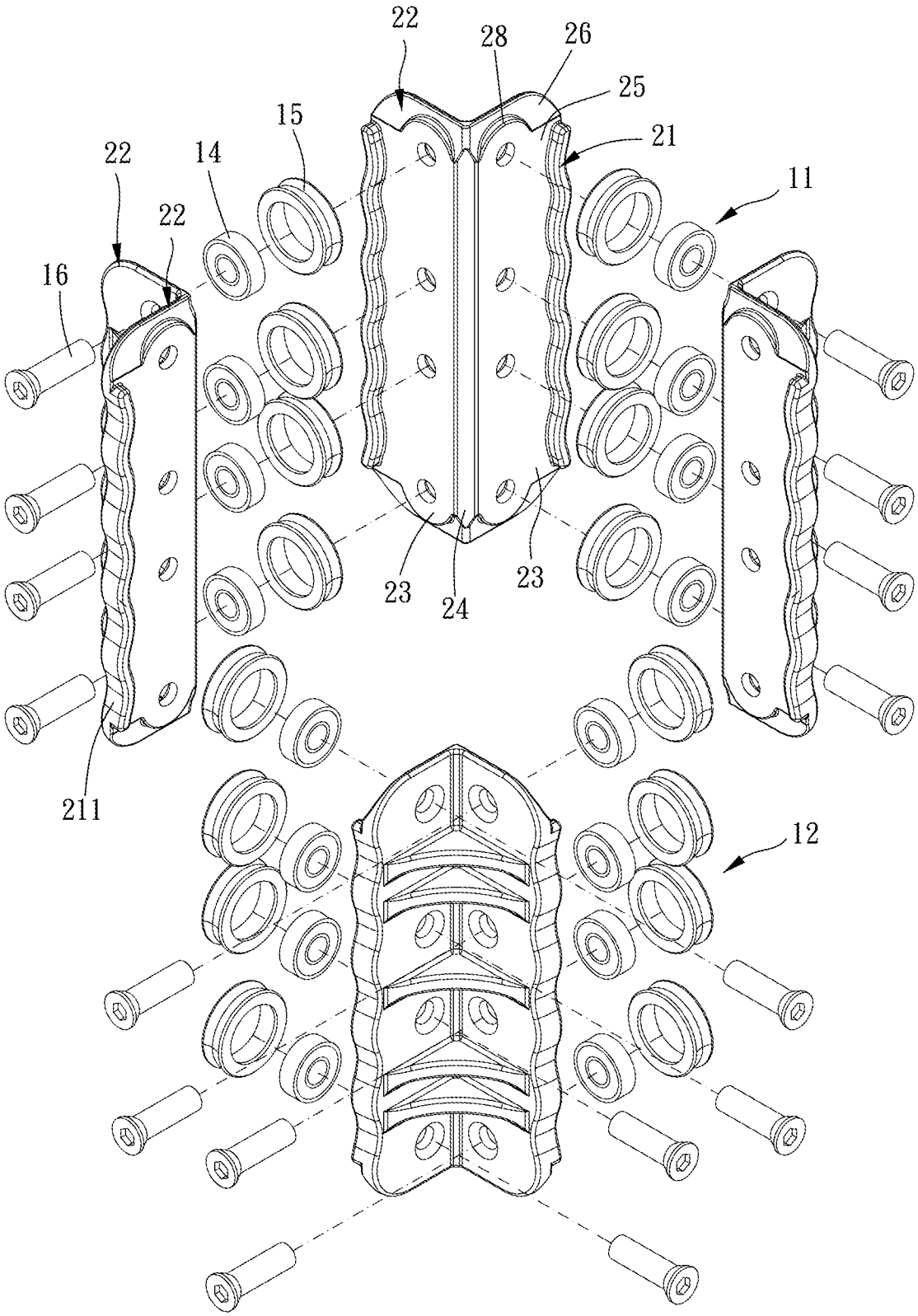
FIG. 2 is a breakdown drawing of the first preferable embodiment of the present invention.
Figure 3:
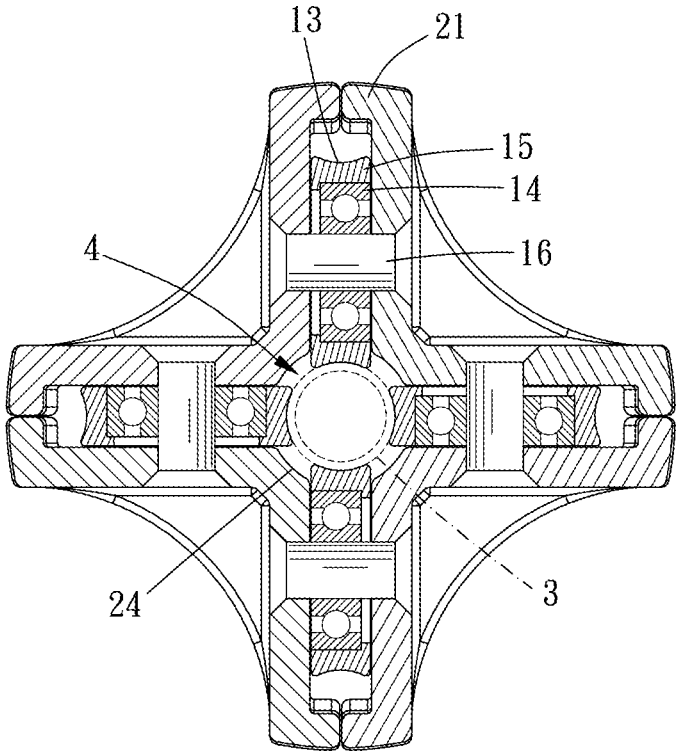
FIG. 3 is a cross-sectional view of the first preferable embodiment of the present invention.
Figure 4:
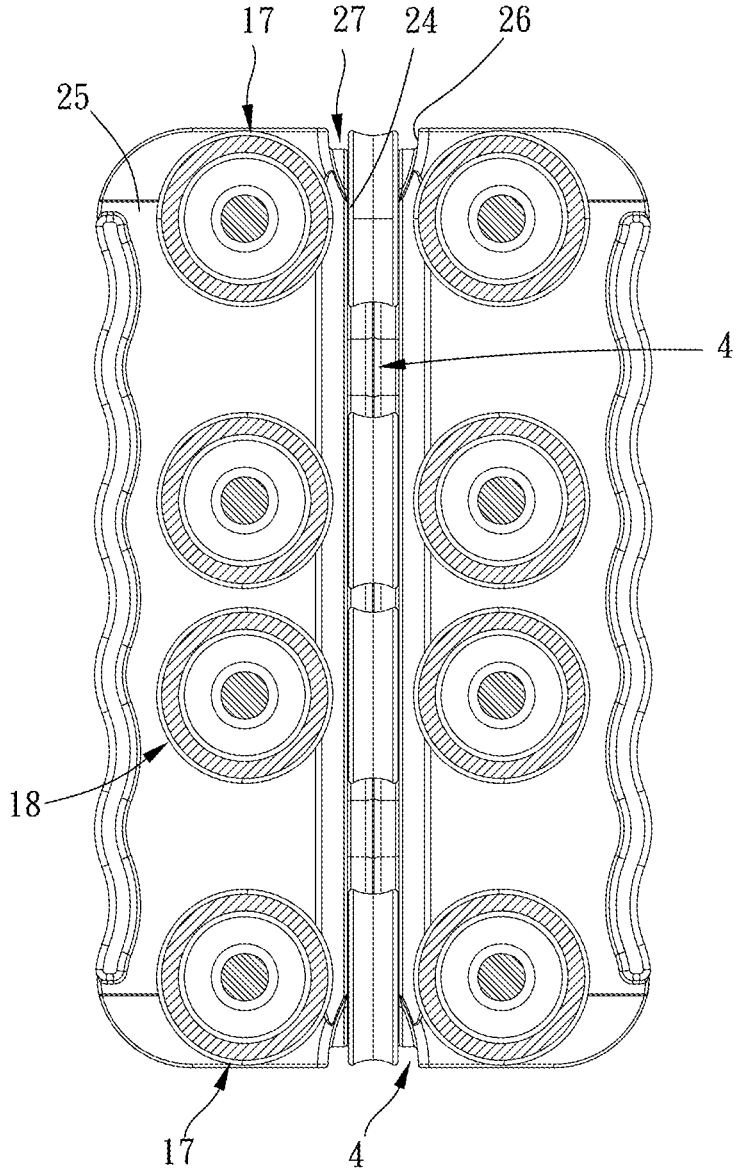
FIG. 4 is a cross-sectional view taken along line A-A of FIG. 1.
Figure 5:
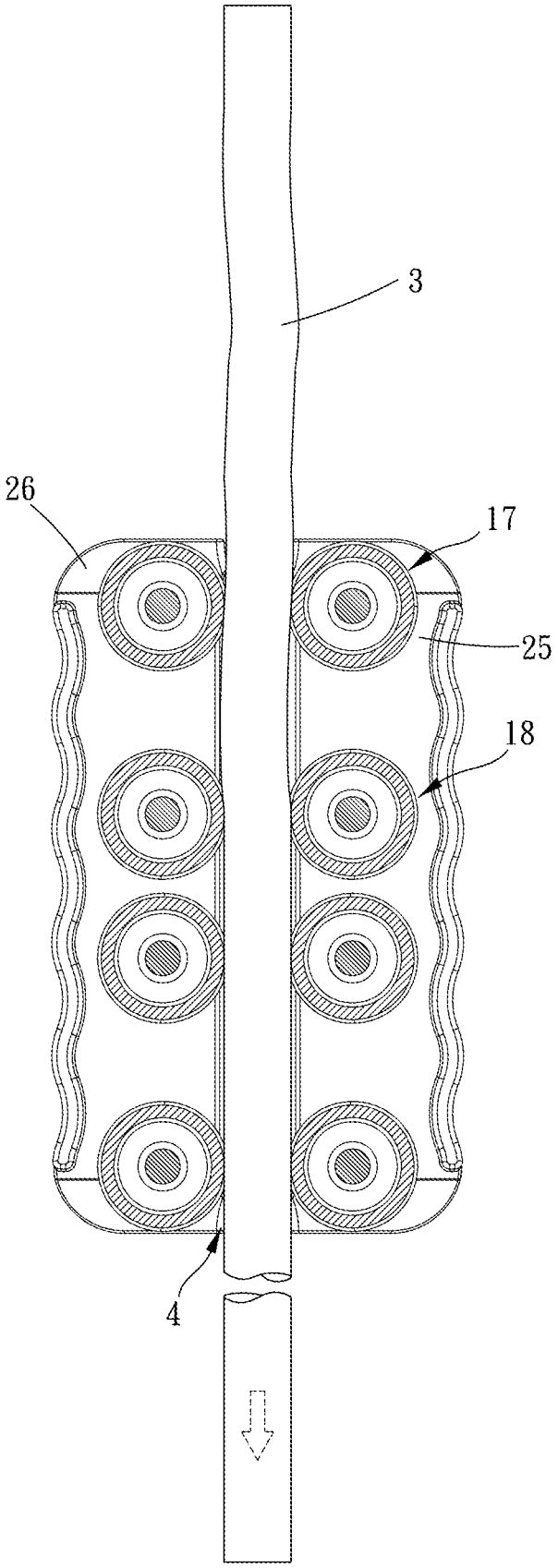
FIG. 5 is a schematic diagram of the first preferable embodiment of the present invention in use.

Please refer to FIGS. 1 to 5 for first preferable embodiment of the present invention. A straightening device of the present invention includes a plurality of rolling members 1 and at least three shells 2.

The plurality of rolling members 1 define a first channel 4 which is configured for a tubular member 3 to pass therethrough, and the tubular member 3 is abuttable against the plurality of rolling members 1 when passing through the first channel 4. An extending direction of the first channel 4 is transverse to at least one axial direction of at least one of the rolling members 1. Each of the at least three shells 2 includes two arm portions 22 which are transversely connected with each other, and each of the arm portions 22 of one of the at least three shells 2 corresponds to one of the arm portions 22 of another of the at least three shells 2. The plurality of rolling members 1 are rotatably disposed between the arm portions 22 of the at least three shells 2. At least one side of at least one of the arm portions 22 has a protruding wall 21. The protruding wall 21 extends along the at least one axial direction of the at least one of the rolling members 1 and is at least partially overlapped with at least one of the plurality of rolling members 1 as viewed in a radial direction of the at least one of the rolling members 1. Therefore, an operator can stably and comfortably hold the straightening device on the protruding wall 21, and dust and scraps can be prevented from entering and sticking on the rolling members 1.

The plurality of rolling members 1 include a plurality of rolling groups, and each of the rolling groups is disposed between two adjacent ones of the arm portions 22. At least two of the plurality of rolling groups, such as a rolling group 11 and a rolling group 12, are arranged with their pivots of the rolling members 1 transverse to each other. Specifically, the at least two rolling groups 11, 12 define the first channel 4 so as to press the tubular member 3 in different directions. In this embodiment, a number of the plurality of rolling groups 11, 12 is four, and the four rolling groups 11, 12 is built into a cross configuration, as viewed from the top. An included angle between radial extending directions of two adjacent rolling groups 11, 12 may be a right angle or non-right angle.

Each of the arm portions 22 has one of the protruding wall 21 which is at least partially overlapped with at least one of the plurality of rolling members 1 as viewed in the radial direction of the at least one of the rolling members 1 for stable holding and blocking dust and scraps. Moreover, respective extents of the protruding walls 21 of two adjacent ones of the at least three shells 2 are equal, which provides stable holding and good resistance to deform. In this embodiment, the protruding walls 21 of two adjacent ones of the arm portions 22 are not overlapped with each other in the radial direction of the at least one of the rolling members 1. In another embodiment, the protruding walls of two adjacent ones of the arm portions may be overlapped with each other.

Each of the at least three shells 2 is L-shaped. Each of the at least three shells 2 has two inner assembling surfaces 23 and an arcuate concave surface 24 connected between the two inner assembling surfaces 23, and each of the inner assembling surfaces 23 is connected with a plurality of rolling members 1, which increases the structural strength and provides convenient holding. Furthermore, each of the rolling members 1 is a roller which defines an axial direction. Each of the rollers has an arcuate abutting concave surface 13 disposed around the axial direction, and the arcuate abutting concave surface 13 is configured to be abutted against the tubular member 3. A curvature of each of the arcuate abutting concave surfaces 13 is smaller than that of each of the arcuate concave surface 24 so as to increase structural strength and effectively resist force applied by hand and the tubular member 3, for stable application of force. Specifically, each of the protruding walls 21 has an outer surface 211 which is wavy for stable holding. In another embodiment, the outer surface may be an arc or have an anti-slip structure. Each of the rollers includes a bearing 14, a ring body 15 sleeved on the bearing 14 and a connecting rod 16 which is penetrated through the bearing 14 and two adjacent ones of the arm portions 22 so that it can rotate smoothly.

Preferably, a plurality of the rolling members 1 which are disposed between two adjacent ones of the arm portions 22 include two first rolling members 17 and a plurality of second rolling members 18 disposed between the two first rolling members 17. A distance between one of the two first rolling members 17 and one of the second rolling members 18 adjacent thereto is larger than a distance between two adjacent ones of the plurality of second rolling members 18 so that the tubular member 3 can be passed smoothly through the first channel 4 and have preferable straightening effect.

Each of the at least three shells 2 has a convex portion 25 protruding in a thickness direction thereof and at least one recession 26 disposed on an end thereof which are disposed in the extending direction of the first channel 4. The plurality of rolling members 1 are disposed on respective convex portions 25 of the at least three shells, and at least one of the plurality of rolling members 1 and one of the recession 26 define a gap 27 therebetween so as to improve structural strength and have preferable supporting force, and the tubular member 3 can be smoothly disposed into the first channel 4. Furthermore, each of the convex portions 25 has at least one arcuate convex 28 which is near at least one opening of the first channel 4, extends around the axial direction of one of the rolling members 1 and is located at one side of one of the rolling members 1.

Figure 6:
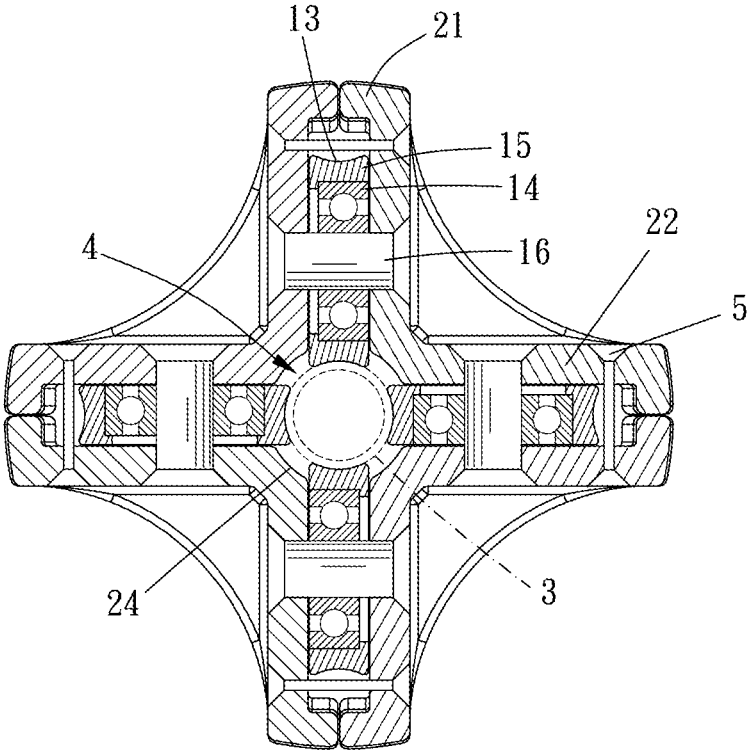
FIG. 6 is a cross-sectional view of a second preferable embodiment of the present invention.

Referring to FIG. 6, the straightening device further includes a plurality of pins 5. Each of the pins 5 is penetrated through two adjacent ones of the arm portions 22 and non-coaxial with each of the rolling members 1, which increases connecting strength between the at least three shells 2.

In operation, the straightening device is held by hand, and the tubular member 3 is penetrated into the first channel 4 from an end of the straightening device. When the tubular member 3 is disposed into the first channel 4, a peripheral surface of the tubular member 3 is abutted against the plurality of rolling members 1 and the tubular member 3 is smoothly passed through the first channel 4 so as to achieve straightening effect. In addition, the protruding walls 21 can provide convenient holding and prevent dust, scraps and other impurities from entering the straightening device.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A straightening device, including:

a plurality of rolling members, defining a first channel which is configured for a tubular member to pass therethrough, the tubular member being abuttable against the plurality of rolling members when passing through the first channel, an extending direction of the first channel being transverse to at least one axial direction of at least one of the rolling members;

at least three shells, each of the at least three shells including two arm portions which are transversely connected with each other, each of the arm portions of one of the at least three shells corresponding to one of the arm portions of another of the at least three shells, the plurality of rolling members being rotatably disposed between the arm portions of the at least three shells, at least one side of each of the arm portions having a protruding wall which is a separate element relative to and disposed adjacent to another one of the arm portions and extends toward the another one of the arm portions, the protruding wall extending along the at least one axial direction of the at least one of the rolling members and being at least partially overlapped with at least one of the plurality of rolling members as viewed in a radial direction of the at least one of the rolling members.

2. The straightening device of claim 1, wherein the plurality of rolling members include a plurality of rolling groups, each of the rolling groups is disposed between two adjacent ones of the arm portions, and at least two of the plurality of rolling groups are arranged with their pivots of the rolling members transverse to each other.

3. The straightening device of claim 1, wherein each of the two arm portions of each of the at least three shells has one said protruding wall.

4. The straightening device of claim 3, wherein respective extents of the protruding walls of two adjacent ones of the at least three shells are equal.

5. The straightening device of claim 1, wherein each of the at least three shells is L-shaped, each of the at least three shells has two inner assembling surfaces and an arcuate concave surface connected between the two inner assembling surfaces, and each of the inner assembling surfaces is connected with a plurality of the rolling members.

6. The straightening device of claim 5, wherein each of the rolling members is a roller which defines an axial direction, each of the rollers has an arcuate abutting concave surface disposed around the axial direction, and the arcuate abutting concave surface is configured to be abutted against the tubular member.

7. The straightening device of claim 1, wherein a plurality of the rolling members which are disposed between two adjacent ones of the arm portions include two first rolling members and a plurality of second rolling members disposed between the two first rolling members, and a distance between one of the two first rolling members and one of the second rolling members adjacent thereto is larger than a distance between two adjacent ones of the plurality of second rolling members.

8. The straightening device of claim 1, wherein each of the at least three shells has a convex portion protruding in a thickness direction thereof and at least one recession disposed on an end thereof which are disposed in the extending direction of the first channel, the plurality of rolling members are disposed on respective convex portions of the at least three shells, and at least one of the plurality of rolling members and one of the recession define a gap therebetween.

9. The straightening device of claim 6, wherein the plurality of rolling members includes a plurality of rolling groups, each of the rolling groups is disposed between two adjacent ones of the arm portions, and at least two of the plurality of rolling groups are arranged with their pivots of the rolling members transverse to each other; each of the arm portions has one of the protruding wall; respective extents of the protruding walls of two adjacent ones of the at least three shells are equal; a plurality of rolling members which are disposed between two adjacent ones of the arm portions include two first rolling members and a plurality of second rolling members disposed between the two first rolling members, a distance between one of the two first rolling members and one of the second rolling members adjacent thereto is larger than a distance between two adjacent ones of the plurality of second rolling members; each of the at least three shells has a convex portion protruding in a thickness direction thereof and at least one recession disposed on an end thereof which are disposed in the extending direction of the first channel, the plurality of rolling members are disposed on respective convex portions of the at least three shells, and at least one of the plurality of rolling members and one of the recession define a gap therebetween; each of the convex portions near at least one opening of the first channel has an arcuate convex which extends around the axial direction of the at least one of the rolling members and is located at one side of one of the rolling members; each of the protruding walls has an outer surface which is wavy; each of the rollers includes a bearing, a ring body sleeved on the bearing and a connecting rod which is penetrated through the bearing and two adjacent ones of the arm portions.

10. The straightening device of claim 1, further including a plurality of pins, each of the pins is penetrated through two adjacent ones of the arm portions and non-coaxial with each of the rolling members.

* * * * *